US012364375B2

(12) United States Patent
Kim et al.

(10) Patent No.: US 12,364,375 B2
(45) Date of Patent: Jul. 22, 2025

(54) VACUUM CLEANER

(71) Applicant: SAMSUNG ELECTRONICS CO., LTD., Suwon-si (KR)

(72) Inventors: Dongjun Kim, Suwon-si (KR); Hun Kang, Suwon-si (KR); Kihwan Kwon, Suwon-si (KR); Kyoungwoung Kim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 329 days.

(21) Appl. No.: 17/993,588

(22) Filed: Nov. 23, 2022

(65) Prior Publication Data

US 2023/0087015 A1 Mar. 23, 2023

Related U.S. Application Data

(63) Continuation of application No. PCT/KR2021/005864, filed on May 11, 2021.

(30) Foreign Application Priority Data

Jul. 10, 2020 (KR) ..... 10-2020-0085336

(51) Int. Cl.
*A47L 9/04* (2006.01)

(52) U.S. Cl.
CPC ..... *A47L 9/0422* (2013.01); *A47L 9/0455* (2013.01); *A47L 9/0477* (2013.01)

(58) Field of Classification Search
CPC ..... A47L 5/30; A47L 11/282; A47L 11/4041; A47L 11/4069; A47L 9/0477;
(Continued)

(56) References Cited

U.S. PATENT DOCUMENTS 4,658,458 A * 4/1987 Berfield ..... A47L 11/4055 15/52.1
9,668,628 B2 6/2017 Kasper
(Continued)

FOREIGN PATENT DOCUMENTS

EP 2 218 385 A2 8/2010
EP 2 218 385 A3 3/2013
(Continued)

OTHER PUBLICATIONS

Extended European Search Report dated Sep. 8, 2023 for European Application No. 21837615.0.
(Continued)

*Primary Examiner* — Bryan R Muller
(74) *Attorney, Agent, or Firm* — STAAS & HALSEY LLP

(57) ABSTRACT

A vacuum cleaner including a cleaner body including a motor configured to generate a suction force and a foreign substance collection chamber; and a suction head connected to the cleaner body. The suction head may include a drum brush, a one-way roller disposed in front of the drum brush, and a housing having a suction port. The drum brush and the one-way roller may be configured so that, when the suction head is moving forward on a surface to be cleaned, the drum brush and the one-way roller rotate so that foreign substances on the surface are suctioned by the suction force into the housing through the suction port to be guided to the foreign substance collection chamber, and when the suction head is moving rearward on the surface, rotation of the one-way roller is restricted to prevent the foreign substances suctioned into the housing from being discharged outside of the housing of the suction head through the suction port.

14 Claims, 15 Drawing Sheets

(58) Field of Classification Search
CPC ..... A47L 9/0488; A47L 5/26; A47L 9/0411; A47L 9/0405; A47L 9/0422; A47L 9/04–0494; B08B 1/34
USPC ..... 15/383, 389, 392, 390
See application file for complete search history.

(56) References Cited

U.S. PATENT DOCUMENTS

| | | | | |
|---|---|---|---|---|
| 2007/0143954 | A1* | 6/2007 | Graham | A47L 9/02 15/364 |
| 2009/0000057 | A1* | 1/2009 | Yoo | A47L 9/04 15/415.1 |
| 2010/0107359 | A1* | 5/2010 | Yoo | A47L 9/0494 15/415.1 |
| 2013/0139349 | A1* | 6/2013 | Iles | A47L 9/04 15/383 |

FOREIGN PATENT DOCUMENTS

| | | |
|---|---|---|
| JP | 2006-110089 | 4/2006 |
| JP | 2015-12885 | 1/2015 |
| JP | 2015-12939 | 1/2015 |
| JP | 2018-175720 | 11/2018 |
| KR | 10-0556811 | 3/2006 |

OTHER PUBLICATIONS

International Search Report dated Sep. 17, 2021, in PCT/KR2021/005864.
Written Opinion of International Searching Authority dated Sep. 17, 2021, in PCT/KR2021/005864.
Office Action issued by the European Patent Office on Aug. 1, 2024 for European Patent Application No. 21 837 615.0.

* cited by examiner

VACUUM CLEANER

CROSS-REFERENCE TO RELATED APPLICATIONS

This application is a continuation application, under 35 U.S.C. § 111(a), of International Patent Application No. PCT/KR2021/005864, filed on May 11, 2021, which is based on and claims priority under 35 U.S.C. § 119 to Korean Patent Application No. 10-2020-0085336, filed on Jul. 10, 2020 in the Korean Intellectual Property Office, the disclosures all of which are hereby incorporated by reference herein in its their entireties.

BACKGROUND

1. Field

The disclosure relates to a vacuum cleaner having a suction head provided with a rotating drum brush, and more particularly, to a suction head having a structure for preventing foreign substances from being separated again.

2. Description of the Related Art

In general, vacuum cleaners are home appliances that perform cleaning and include a suction force generation device (a motor) that generates a suction force, a suction head that suctions air and foreign substances on a cleaning surface through the suction force of the suction force generation device (the motor), and a foreign substance collection chamber that separates and collects foreign substances from the air suctioned through the suction head.

The suction head may include a housing having a suction port and a drum brush that sweeps the cleaning surface to guide foreign substances on the cleaning surface to be efficiently suctioned into the suction port. The drum brush may be rotatably provided and connected to a driver.

The foreign substances suctioned into the suction head are completely suctioned into the foreign substance collection chamber of the cleaner when the suction head moves forward, and thus the foreign substances are not separated back to the outside of the suction head.

On the other hand, when the suction head moves rearward, the foreign substances are separated back to the outside of the suction head according to the positions of the foreign substances in the suction head during a cleaning process, and thus the cleaning may not be performed smoothly. Such a cleaning state may occur more frequently as the size of the foreign substances to be suctioned becomes larger.

SUMMARY

Aspects of embodiments of the disclosure will be set forth in part in the description which follows and, in part, will be apparent from the description, or may be learned by practice of the presented embodiments. According to an embodiment of the disclosure, a vacuum cleaner may include a cleaner body including a motor configured to generate a suction force and a foreign substance collection chamber; and a suction head connected to the cleaner body. The suction head may include a drum brush, a one-way roller disposed in front of the drum brush, and a housing having a suction port. The drum brush and the one-way roller may be configured so that, when the suction head is moving forward on a surface to be cleaned, the drum brush and the one-way roller rotate so that foreign substances on the surface are suctioned by the suction force into the housing through the suction port to be guided to the foreign substance collection chamber, and when the suction head is moving rearward on the surface, rotation of the one-way roller is restricted to prevent the foreign substances suctioned into the housing from being discharged outside of the housing of the suction head through the suction port.

According to an embodiment of the disclosure, the one-way roller includes a roller shaft, and a roller body that is fixed to an outer circumferential surface of the roller shaft and configured so that, when the suction head is on the surface, the roller body contacts at least some of the foreign substances on the surface under the suction head.

According to an embodiment of the disclosure, the vacuum cleaner may further include a one-way clutch bearing connected to at least one end of the roller shaft and configured to support the at least one end of the roller shaft.

According to an embodiment of the disclosure, the one-way clutch bearing locks the roller shaft so that the roller shaft rotates during the forward movement of the suction head, and unlocks the roller shaft so that the roller shaft is restricted from rotation during the rearward movement of the suction head.

According to an embodiment of the disclosure, the one-way roller further includes a foreign substance contactor disposed on an outer circumferential surface of the roller body and including a villus configured to, when the suction head is on the surface, contact the at least one of the foreign substances on the surface under the suction head.

According to an embodiment of the disclosure, the vacuum cleaner may further include a wheel module disposed on at least one end of the one-way roller at which the roller shaft is connected to the one-way clutch bearing, and configured to support the at least one end of the roller shaft through the one-way clutch bearing.

According to an embodiment of the disclosure, the wheel module includes a wheel frame to which the one-way clutch bearing is fixed on an inner side surface of the wheel frame; a wheel shaft protruding from an outer side surface of the wheel frame and configured as a rotary shaft of the wheel frame; and a wheel bearing supporting the wheel shaft.

According to an embodiment of the disclosure, the wheel module and the one-way roller rotate when the suction head is moving forward, and the one-way roller is restricted from movement and the wheel module rotates when the suction head is moving rearward.

According to an embodiment of the disclosure, the housing includes a roller seat in which the one-way roller is disposed, and an inner circumferential surface of the roller seat is provided in a shape so that an upper outer circumferential surface of the one-way roller contacts the one-way roller to provide friction between the inner circumferential surface of the roller seat and the upper outer circumferential surface of the one-way roller.

According to an embodiment of the disclosure, the housing may further includes a wheel seat which is formed on one side of the roller seat and accommodates the wheel module. and a wheel bearing seat which is formed on an outer side of the wheel seat and in which the wheel bearing is seated.

According to an embodiment of the disclosure, the wheel bearing seat includes an opening facing a bottom surface of the housing, and the vacuum cleaner further includes a support hook configured to close the opening and support the wheel bearing seated in the wheel bearing seat, the support hook having one end rotatably coupled to the housing, and having another end connected to the housing so as to support the wheel bearing.

According to an embodiment of the disclosure, the wheel frame includes a wheel frame groove formed in the inner surface of the wheel frame so that the one-way clutch bearing is fixedly inserted into the wheel frame groove.

According to an embodiment of the disclosure, a diameter of the wheel module is greater than a diameter of the one-way roller.

According to an embodiment of the disclosure, the vacuum cleaner may further include a plurality of the wheel modules. At least one wheel module of the plurality of wheel modules may further include an outer cover member fixed to and surrounding an outer circumferential surface of the wheel frame of the wheel module.

According to an embodiment of the disclosure, the outer cover member is configured so as to, when the suction head is on the surface, contact the surface, and is formed of a rubber material to increase a frictional force with the surface.

Another embodiment of the disclosure provides a suction head for a vacuum cleaner including a housing having a suction port, a drum brush rotatably installed inside the housing so that foreign substances on a cleaning surface are suctioned into the housing through the suction port, a one-way roller disposed in front of the drum brush and installed in a roller seat formed inside the housing to be rotatable about a roller shaft, and a wheel module having one side fixed to a one-way clutch bearing that supports one end of the shaft, wherein the one-way roller is disposed in close contact with an inner circumferential surface of the roller seat so that the one-way roller and the roller seat rub mutually, and the suction head locks the shaft based on forward movement of the suction head and unlocks the shaft based on rearward movement of the suction head.

The housing may include a roller seat on which the one-way roller is disposed, an inner circumferential surface of the roller seat may be provided in a shape corresponding to an upper outer circumferential surface of the one-way roller to be in close contact with the one-way roller, both of the wheel module and the one-way roller may rotate based on the forward movement of the suction head, and the one-way roller may be fixed and only the wheel module may rotate based on the rearward movement of the suction head.

The wheel module may include a wheel frame to which the one-way clutch bearing is fixed on one side surface thereof, a wheel shaft protruding from the other side surface of the wheel frame and provided as a rotary shaft of the wheel frame, and a wheel bearing that supports the wheel shaft.

The housing may further include a wheel seat which is formed on one side of the roller seat and accommodates the wheel module, and a wheel bearing seat which is formed on one side of the wheel seat and in which the wheel bearing is seated.

The wheel bearing seat may include an opening open to face a bottom surface of the housing. The vacuum cleaner may further include a support hook that closes the opening, supports the wheel bearing seated in the wheel bearing seat, has one end rotatably coupled to the housing, and has the other end fixedly hooked to the housing.

Additional embodiments of the disclosure will be set forth in part in the description which follows and, in part, will be obvious from the description, or will be apparent from the disclosure.

BRIEF DESCRIPTION OF THE DRAWINGS

These and/or other embodiments of the disclosure will become apparent and more readily appreciated from the following description of the embodiments, taken in conjunction with the accompanying drawings of which.

DETAILED DESCRIPTION

Figure 1:
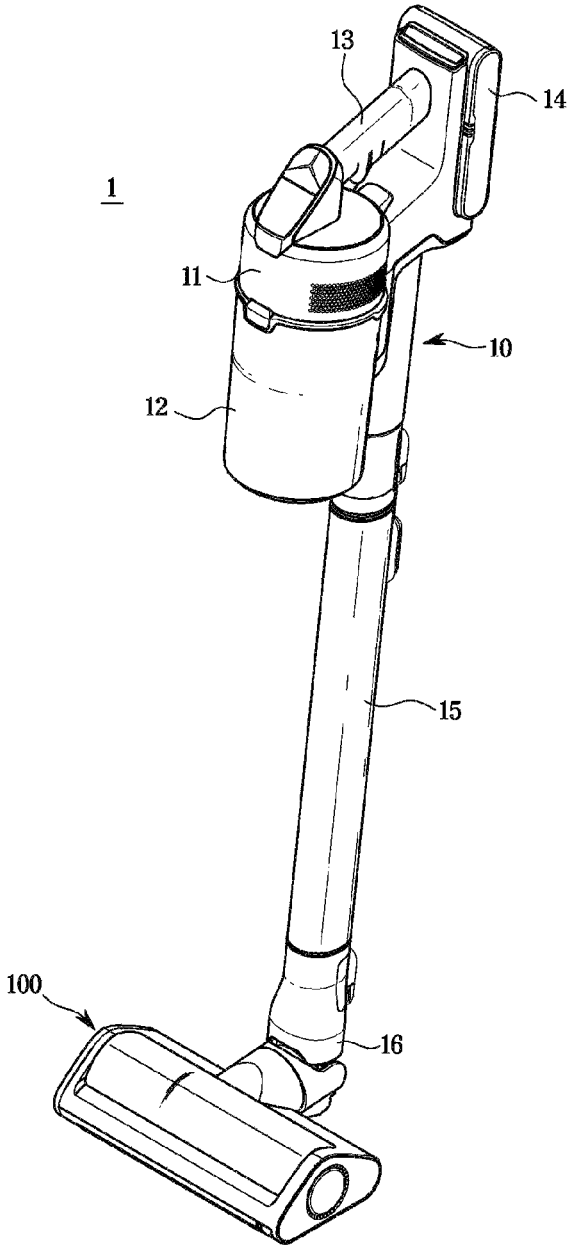
FIG. 1 is a view illustrating a vacuum cleaner according to an embodiment of the disclosure.

Configurations illustrated in embodiments and the accompanying drawings disclosed in the present specification are merely exemplary embodiments of the disclosure, and various modifications that may replace the embodiments and the drawings of the present specification may be present at a time of filing of the present application.

Further, the same reference numerals or symbols presented in each drawing of the present specification indicate parts or components that perform substantially the same function.

Further, terms used in the present specification are used only to describe the embodiments and are not intended to limit/restrict the disclosure. Singular expressions include plural expressions unless clearly otherwise indicated in the context. In the present specification, terms such as "include" or "have" are intended to indicate that there are features, numbers, steps, operations, components, parts, or combinations thereof that are described in the specification and do not exclude, in advance, the possibility of the presence or addition of one or more other features, numbers, steps, operations, components, parts, or combinations thereof.

Further, in the present specification, terms including ordinal numbers such as "first" and "second" may be used to describe various components, but the components are not limited by the above terms, and the terms are used only to distinguish one component from other components. For example, without departing from the scope of the disclosure, a first component may be referred to as a second component, and similarly, a second component may be referred to as a first component. Term "and/or" includes any or a combination of a plurality of related listed items or any item of the plurality of related listed items.

The disclosure is directed to providing a vacuum cleaner having a structure that prevents foreign substances introduced into a suction head from being separated and returned to the outside of the suction head when the suction head is moved forward or backward.

The disclosure is also directed to providing a vacuum cleaner that is easily repaired, replaced, and cleaned because a one-way roller that performs a foreign substance re-separation prevention function may be separated from the suction head.

Figure 2:
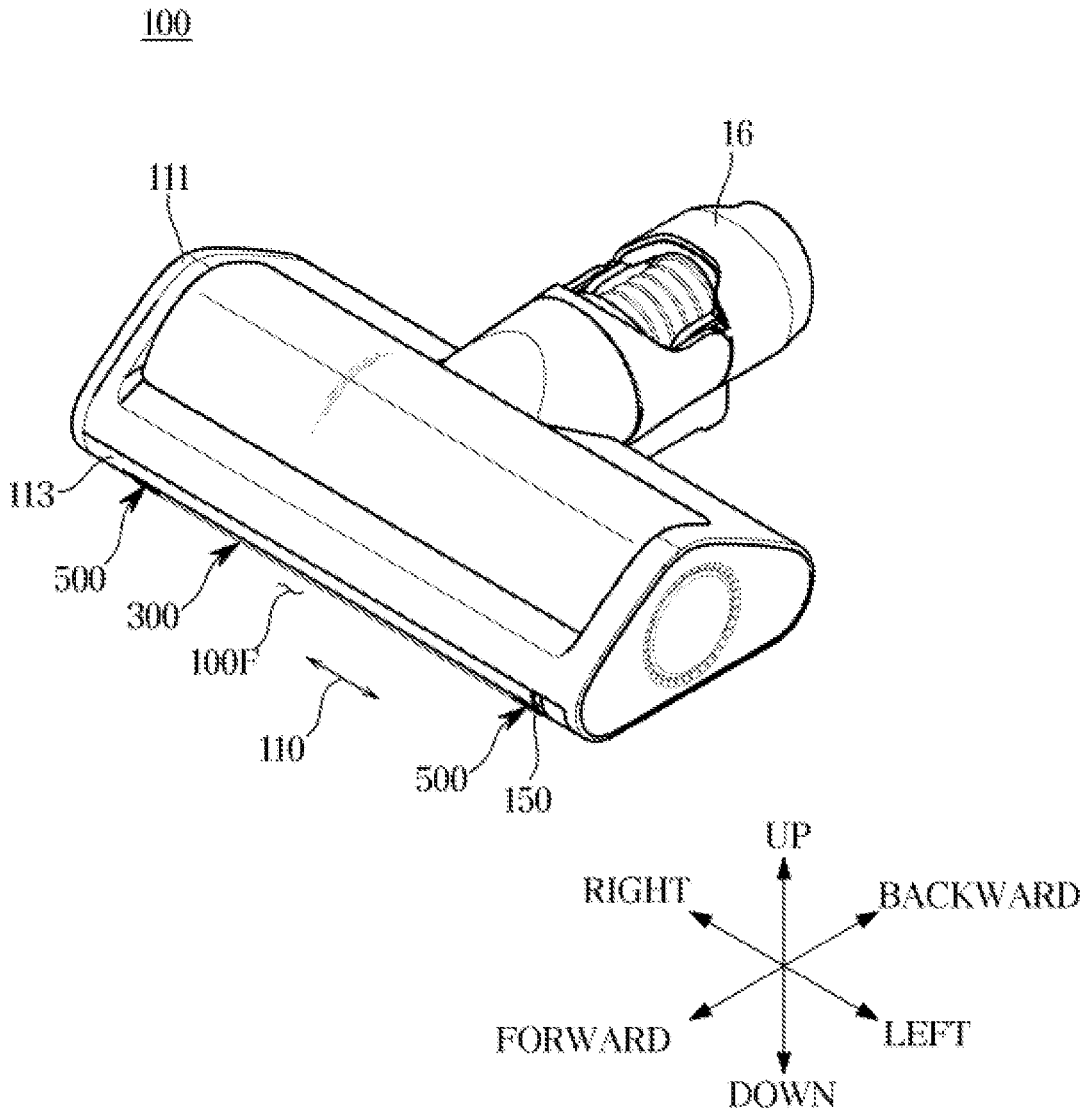
FIG. 2 is a perspective view illustrating a suction head of the vacuum cleaner according to an embodiment of the disclosure.
Figure 3:
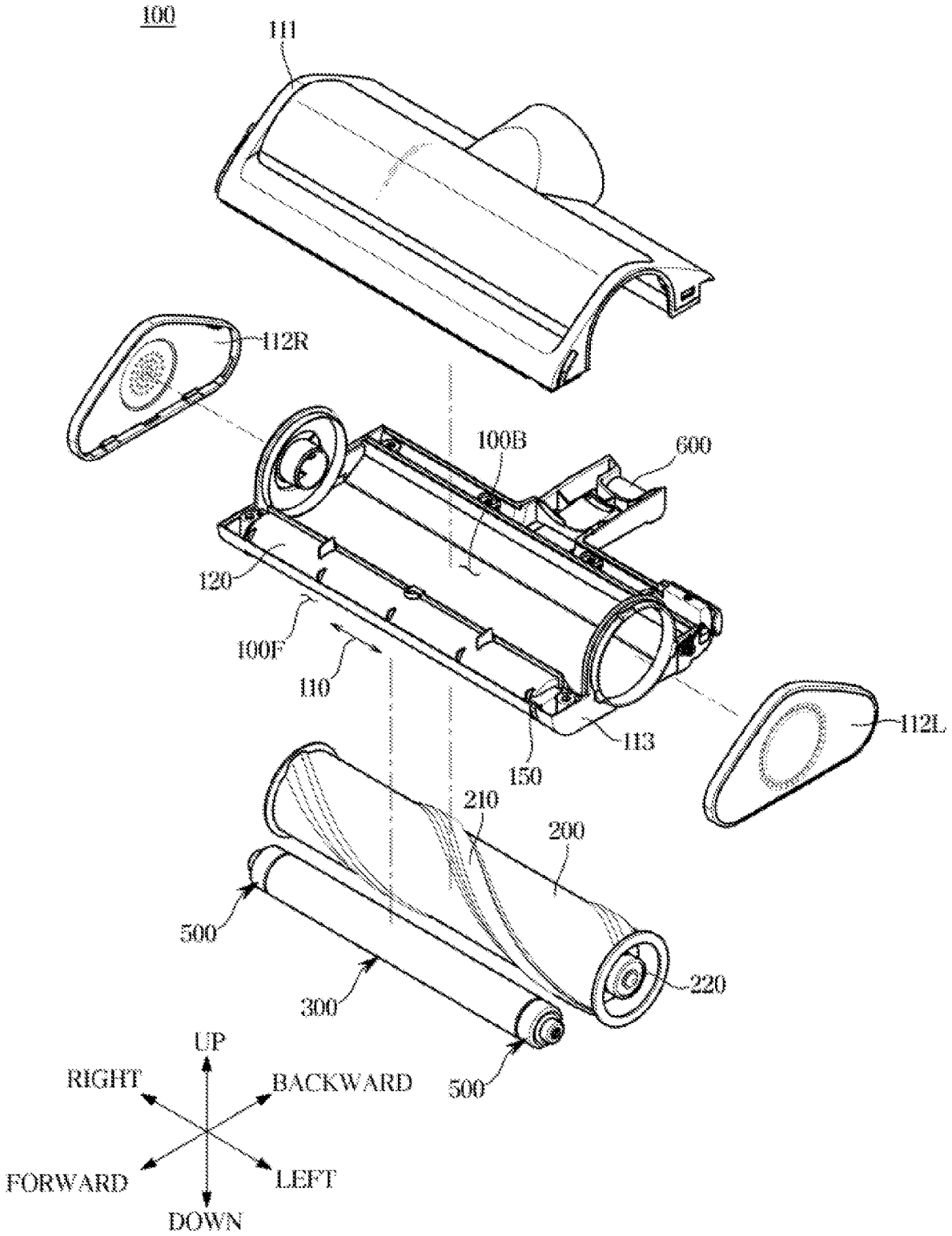
FIG. 3 is an exploded view illustrating the suction head of the vacuum cleaner according to the embodiment of the disclosure.

Referring to FIGS. 2 and 3, the term "front" used in the following description is defined in a direction in which a suction head 100 moves forwards, and "rear," "upper," "lower," and "left/right" are defined on the basis of the term "forward."

Meanwhile, the terms such as "front," "rear," "upper," and "lower" used in the following description are defined on the basis of the drawings, and the shape and position of each component is not limited by the terms.

Hereinafter, embodiments of the disclosure will be described in detail with reference to the accompanying drawings.

Figure 4:
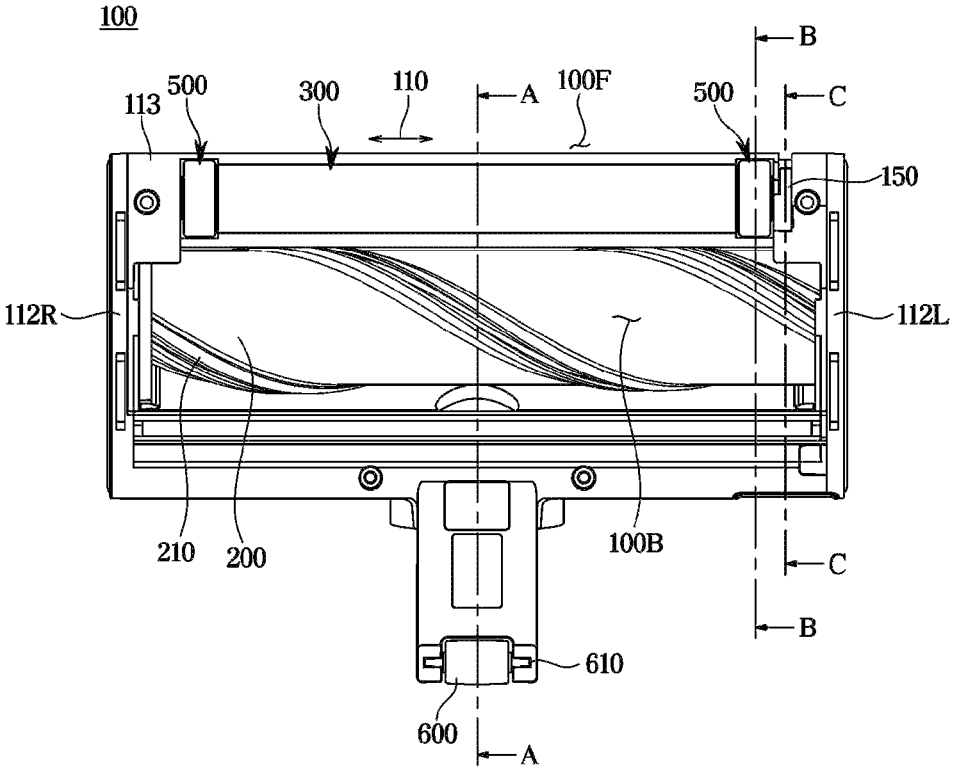
FIG. 4 is a bottom view illustrating the suction head of the vacuum cleaner according to the embodiment of the disclosure.
Figure 5:
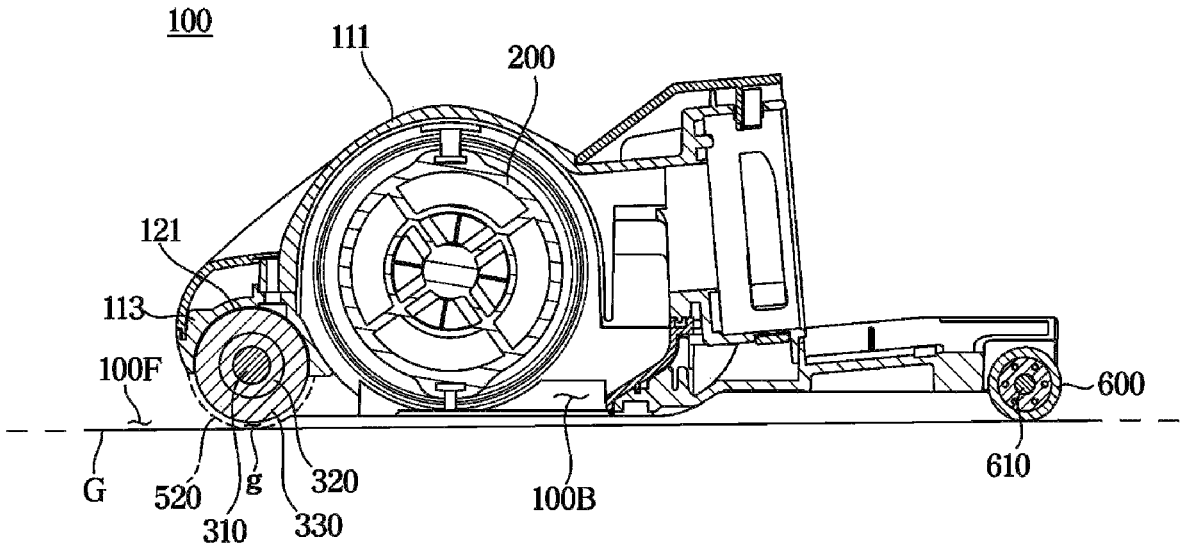
FIG. 5 is a cross-sectional view along line A-A of FIG. 4 when viewed from the left side.

FIG. 1 is a view illustrating a vacuum cleaner according to an embodiment of the disclosure. FIG. 2 is a perspective view illustrating a suction head of the vacuum cleaner according to an embodiment of the disclosure. FIG. 3 is an exploded view illustrating the suction head of the vacuum cleaner according to the embodiment of the disclosure. FIG. 4 is a bottom view illustrating the suction head of the vacuum cleaner according to the embodiment of the disclosure. FIG. 5 is a cross-sectional view along line A-A of FIG. 4 when viewed from the left side. Referring to FIG. 1, a vacuum cleaner 1 may include a cleaner body 10, the suction head 100, and an extension tube 15 connecting the cleaner body 10 and the suction head 100.

The cleaner body 10 may include a motor 11 that is a suction force generation device for generating a suction force, a foreign substance collection chamber 12 that separates foreign substances D from the suctioned air and collects the foreign substances D, a handle 13, and a battery 14 that may supply power to the motor 11.

The motor 11 functions to convert an electric force into a mechanical rotational force. A fan (not illustrated) that is connected to the motor 11 and rotates may be provided. The foreign substance collection chamber 12 may collect the foreign substances D through a cyclone method of separating the foreign substances D using a centrifugal force or a dust bag method of separating the foreign substances D by passing air through a filtration bag. The air which passes through the foreign substance collection chamber 12 and from which the foreign substances D are removed may be discharged to the outside of the cleaner body 10.

The extension tube 15 may be formed of a pipe having a predetermined rigidity or a flexible hose. The extension tube 15 may transfer, to the suction head 100, the suction force generated through the motor 11, and guide, to the cleaner body 10, the air and the foreign substances D suctioned through the suction head 100.

The suction head 100 may suction the air and the foreign substances D on a cleaning surface while in close contact with the cleaning surface. In detail, while moving forward, the suction head 100 may suction the foreign substances D scattered in front 100F of the suction head 100 into housings 111, 112L, 112R, and 113. The suction head 100 may be rotatably coupled to the extension tube 15.

Referring to FIGS. 2 to 5, the suction head 100 may include the housings 111, 112L, 112R, and 113 between which a suction port 100B is formed, a drum brush 200 that rotates so that the foreign substances D are effectively suctioned into the housings 111, 112L, 112R, and 113 through the suction port 100B, and a connector 16 connecting the housings 111, 112L, 112R, and 113 and the extension tube 15.

The suction head 100 may further include a one-way roller 300 disposed in front of the drum brush 200. The suction head 100 may further include a plurality of wheel modules 500 that are arranged at both ends of the one-way roller 300 and assist forward/rearward movement of the suction head 100.

The suction head 100 may further include an auxiliary wheel 600 that assists the forward/rearward movement of the suction head 100 together with the wheel modules 500. The auxiliary wheel 600 may be provided to be rotated by an auxiliary wheel shaft 610 fixed to the housings, particularly, the lower housing 113.

Figure 11:
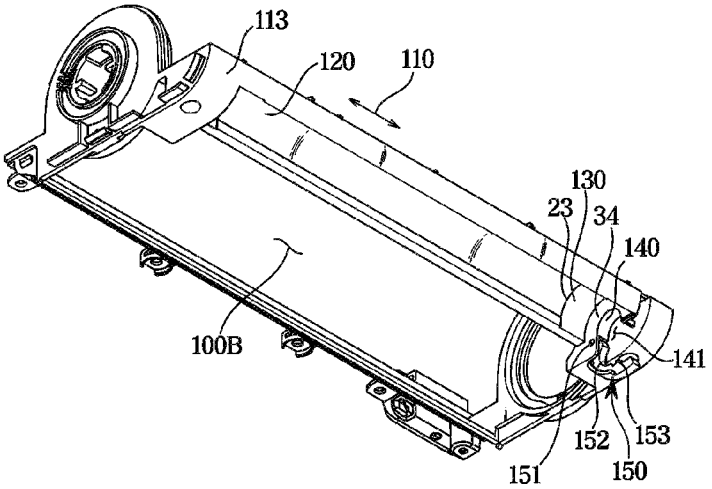
FIG. 11 is a perspective view illustrating a bottom surface of a lower housing of the suction head of the vacuum cleaner according to an embodiment of the disclosure.

Referring to FIGS. 4 and 11, the suction head 100 may be supported by the wheel modules 500 arranged in front of the drum brush 200 and the auxiliary wheel 600 disposed behind the drum brush 200. FIG. 4 illustrates a structure in which the suction head 100 is supported at three points by the plurality of wheel modules 500 and the auxiliary wheel 600, but the number of the wheel modules 500 and the number of the auxiliary wheel 600 are not limited thereto.

The housings 111, 112L, 112R, and 113 may be formed by assembling the upper housing 111, the lower housing 113, the left side cover or housing 112L, and the right side cover or housing 112R. A bottom surface of the lower housing 113 is formed in an open shape so that the suction port 100B may be provided. In the following description, the term "housing" may be used as a term referred to as the lower housing 113.

The suction port 100B may be formed in the lower housing 113. The air and the foreign substances D suctioned into the housings 111, 112L, 112R, and 113 through the suction port 100B may be transferred to the extension tube 15 through the connector 16. The foreign substances D may be collected in the foreign substance collection chamber 12 through the extension tube.

Referring to FIGS. 3 and 4, in the lower housing 113, the suction port 100B may be formed to extend in a lengthwise direction of the housing. The connector 16 may be formed at the center of the housings 111, 112L, 112R, and 113 in the lengthwise direction 110.

A connection port (not illustrated) connected to the connector 16 may be formed in the upper housing 111. A foreign substance removal pad (not illustrated) may be provided on an inner circumferential surface (not illustrated) of the upper housing 111.

The drum brush 200 may be rotatably provided inside the housings 111, 112L, 112R, and 113. In detail, the drum brush 200 may be rotatably provided in the lower housing 113.

Drum brush bearings 220 (see FIG. 3) that assist a rotational movement of the drum brush 200 may be provided at both ends of a rotary shaft of the drum brush 200.

A drum brush slot may be provided in the lower housing 113 such that the drum brush 200 is rotatably seated thereon. The drum brush slot may be provided in a circular shape to correspond to the shape of both sides of the drum brush 200. However, the shape of the drum brush slot is not limited thereto, and the drum brush slot may be formed in various shapes in which the drum brush 200 may be rotatably provided inside the lower housing 113, that is, the housings 111, 112L, 112R, and 113.

The left side cover 112L and the right side cover 112R may be coupled to both side surfaces of the lower housing 113. In detail, the left side cover 112L and the right side cover 112R may be arranged on both side surfaces of the drum brush slot.

The suction head 100 may include a driver (not illustrated) for providing a rotational force to rotate the drum brush 200.

The drum brush 200 may include a cylindrical drum body and a brush 210 provided on an outer circumferential surface of the drum body to sweep the cleaning surface and scatter the foreign substances D. The brush 210 may be fixedly inserted into a spiral seating groove formed in the outer circumferential surface of the drum body of the drum brush 200 so as to be fixed to the outer circumferential surface of the drum body.

When the suction head 100 moves forward, the foreign substances D on the cleaning surface may be suctioned into the housings 111, 112L, 112R, and 113. The suction port 100B may be formed in the lower housing 113. The foreign substances D may be scattered to the upper side of the suction port 100B by the rotation of the drum brush 200. The air and the scattered foreign substances D suctioned into the housings 111, 112L, 112R, and 113 through the suction port 100B may be transferred to the extension tube 15 through the connector 16. The foreign substances D may be collected in the foreign substance collection chamber 12 through the extension tube 15.

On the other hand, when the suction head 100 moves rearward, the foreign substances D may be separated and returned to the outside of the suction head 100 according to the positions of the foreign substances D in the suction head 100 during a cleaning process, and thus the cleaning may not be performed smoothly. Although a frequency is lower than in a case in which the suction head 100 moves rearward, this state may occur even when the suction head 100 moves forward. Such a cleaning state may occur more frequently as the size of the foreign substances D to be suctioned becomes larger.

To solve these problems, the one-way roller 300 may be disposed in front of the drum brush 200 to prevent the foreign substances D from being separated and returned to the outside of the housing. In detail, the one-way roller 300 may rotate so that the foreign substances D move into the housings 111, 112L, 112R, and 113 when the suction head 100 moves forward, and the rotation of the one-way roller 300 may be restricted so that the foreign substances D are not discharged to the outside of the housings 111, 112L, 112R, and 113 when the suction head 100 moves rearward (see FIGS. 3 and 4).

Referring to FIGS. 3 and 5, a roller seat 120 may be formed in the lower housing 113 so that the one-way roller 300 may be rotatably seated in front of the drum brush 200. The one-way roller 300 may be disposed in close contact with the roller seat 120. A region 121 in which the roller seat 120 and the one-way roller 300 rub mutually while in close contact with each other may be formed. A diameter D1 of the one-way roller 300 may be formed smaller than the diameter of the drum brush 200.

The plurality of wheel modules 500 rotatably supported by the one-way roller 300 may be provided at both ends of the one-way roller 300. The wheel modules 500 may also be rotatably supported by the lower housing 113.

A structure in which the one-way roller 300 rotates so that the foreign substances D move into the housings 111, 112L, 112R, and 113 when the suction head 100 moves forward, and the rotation of the one-way roller 300 is restricted so that the foreign substances D are prevented from being discharged to the outside of the housings 111, 112L, 112R, and 113 when the suction head 100 moves rearward, may be roughly implemented using two structures.

The first structure may be implemented using the plurality of wheel modules 500 provided at both ends of the one-way roller 300 and rotatably supported by the one-way roller 300 and a one-way clutch bearing 400 fixed to the wheel modules 500.

Schematically, the one-way clutch bearing 400 may be provided to lock a roller shaft 310 that is a rotation axis of the one-way roller 300 when the suction head 100 moves forward, and unlocks the roller shaft 310 when the suction head 100 moves rearward.

Since the one-way clutch bearing 400 is fixed to the wheel modules 500, a state in which the one-way clutch bearing 400 locks the roller shaft 310 may be a state in which a rotational force of the wheel modules 500 is transmitted to the one-way roller 300 and thus the one-way roller 300 also rotates.

In contrast, a state in which the one-way clutch bearing 400 unlocks the roller shaft 310 when the suction head 100 moves rearward may be a state in which the rotational force of the wheel modules 500 is not transmitted to the one-way roller 300, and thus even when the wheel modules 500 rotate, the one-way roller 300 may have a different motion state from the wheel modules 500.

The second structure may be implemented using a close contact structure between the roller seat 120 and the one-way roller 300. The state in which the one-way clutch bearing 400 unlocks the roller shaft 310 when the suction head 100 moves rearward, and thus even when the wheel modules 500 rotate, the one-way roller 300 may have the different motion state from the wheel modules 500 may be the same as above.

Thus, in this case, the rotation of the one-way roller 300 may be restricted by a frictional force caused by the close contact structure between the roller seat 120 and the one-way roller 300. The rotation of the one-way roller 300 is restricted, the foreign substances D are caught by the one-way roller 300 and thus may be provided so as not to be discharged to the outside of the housings 111, 112L, 112R, and 113.

Detailed descriptions of the one-way roller 300, the wheel modules 500, and the lower housing 113 will be described below.

Figure 6:
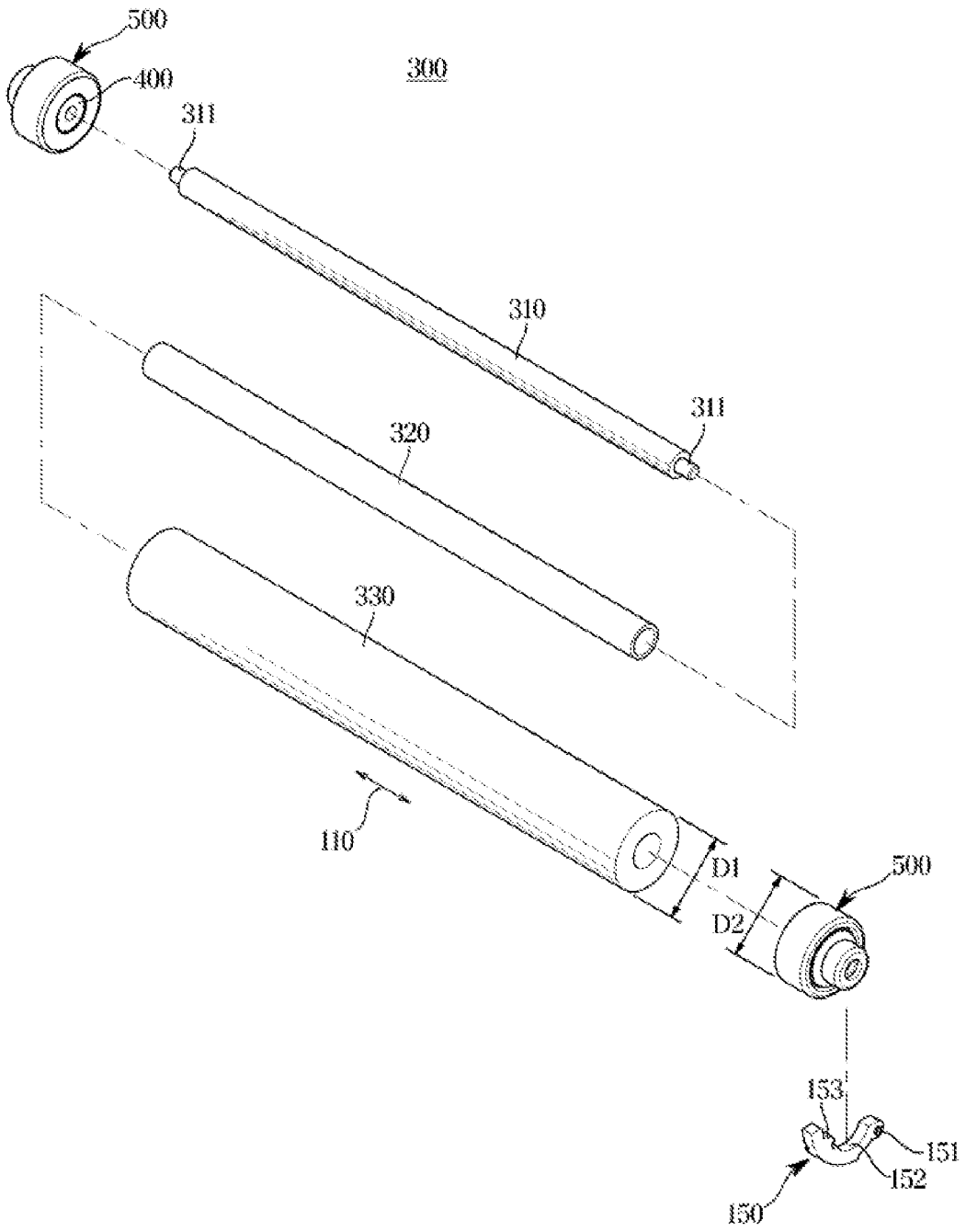
FIG. 6 shows an exploded perspective view illustrating a one-way roller of the vacuum cleaner and a perspective view of a wheel module and a support hook according to an embodiment of the disclosure.
Figure 7:
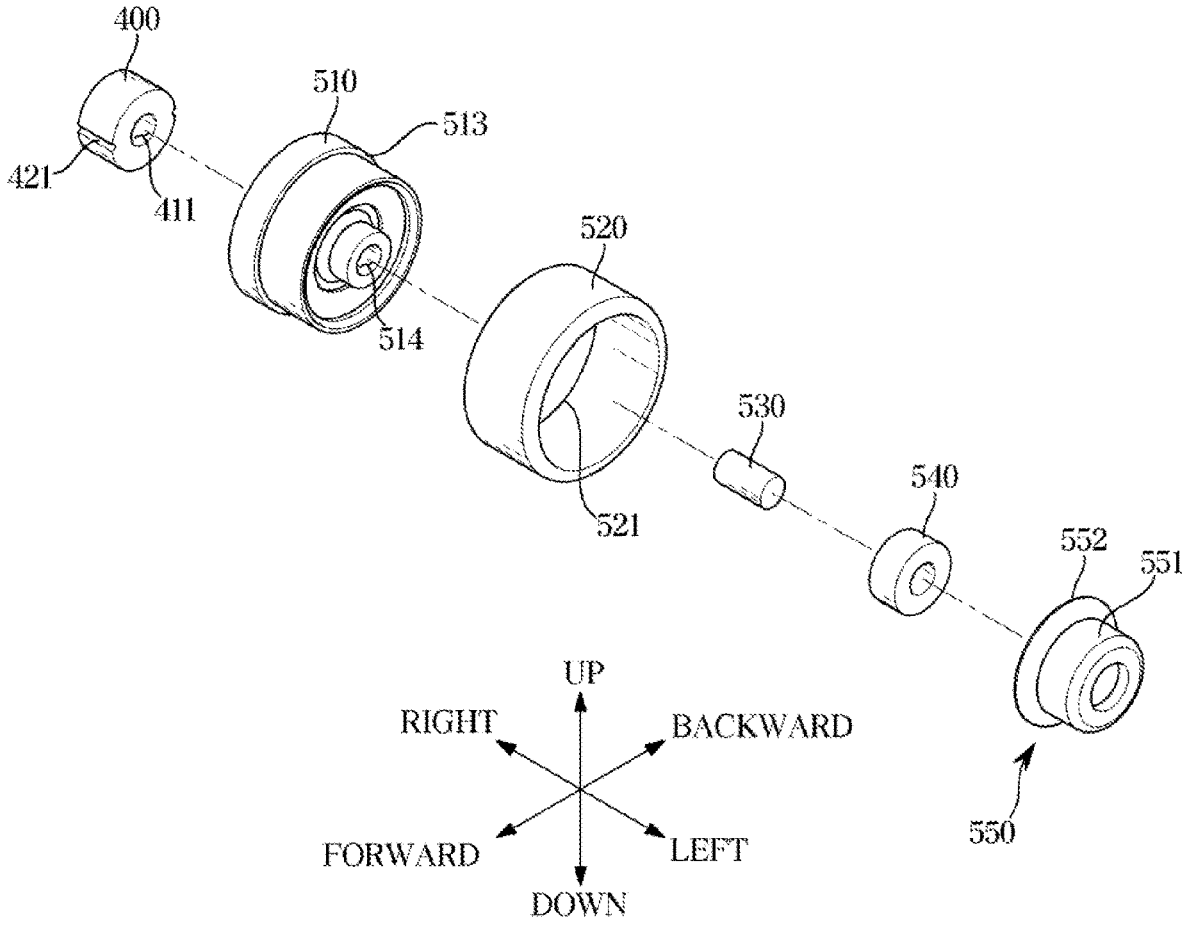
FIG. 7 is an exploded perspective view illustrating the wheel module of the vacuum cleaner according to the embodiment of the disclosure.
Figure 8:
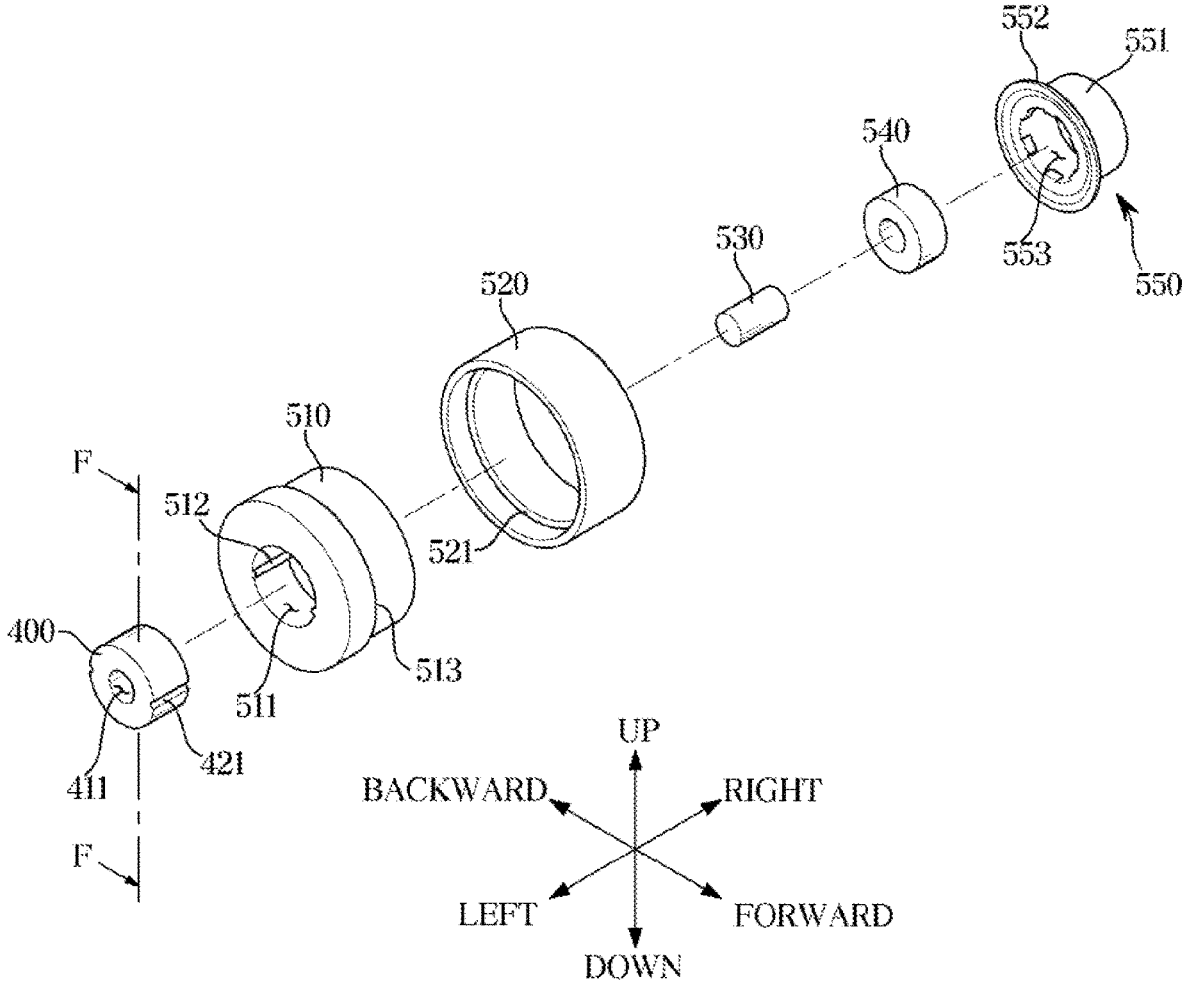
FIG. 8 illustrates the exploded perspective view of FIG. 7 when viewed in another direction.
Figure 9:
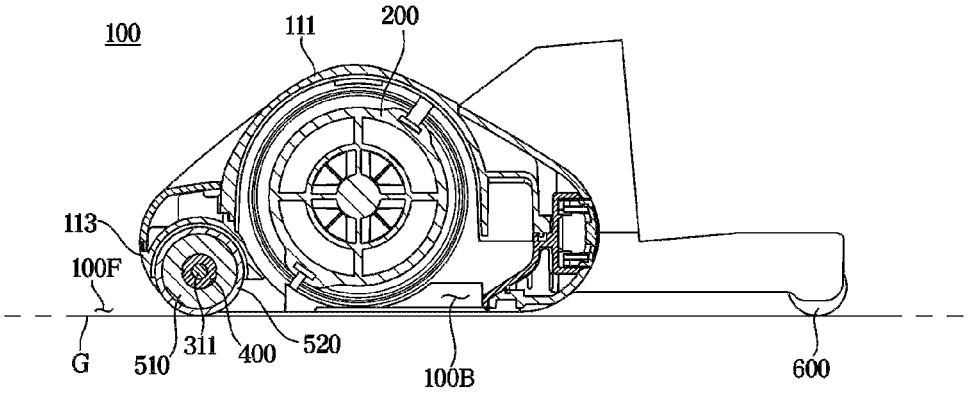
FIG. 9 is a cross-sectional view along line B-B of FIG. 4 when viewed from the left side.

FIG. 6 shows an exploded perspective view illustrating a one-way roller of the vacuum cleaner and a perspective view of a wheel module and a support hook according to an embodiment of the disclosure. FIG. 7 is an exploded perspective view illustrating the wheel module of the vacuum cleaner according to the embodiment of the disclosure. FIG. 8 illustrates the exploded perspective view of FIG. 7 when viewed in another direction. FIG. 9 is a cross-sectional view along line B-B of FIG. 4 when viewed from the left side.

Figure 10:
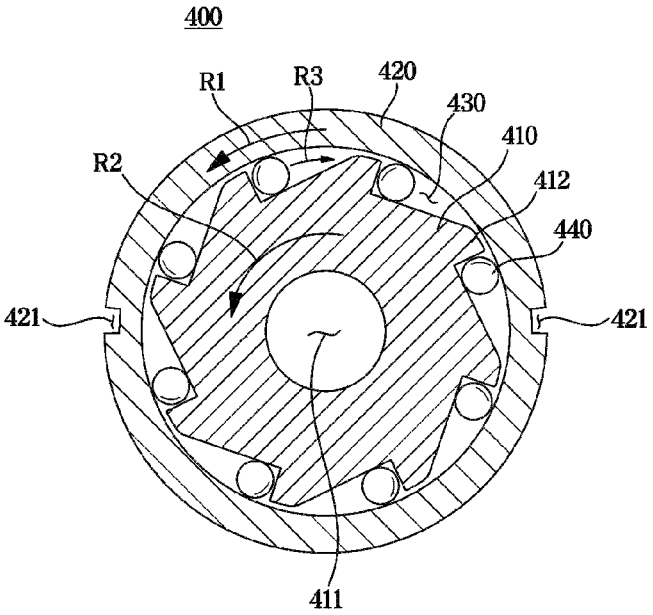
FIG. 10 is a cross-sectional view along line F-F of FIG. 8 when viewed from the left side.

FIG. 10 is a cross-sectional view along line F-F of FIG. 8 when viewed from the left side.

Referring to FIGS. 5 and 6, the one-way roller 300 may include the roller shaft 310 and a roller body 320. The one-way roller 300 may further include a foreign substance contactor 330 disposed on an outer circumferential surface of the roller body 320.

The roller shaft 310 may be formed in a cylindrical shape extending in a lengthwise direction 110 of the housing (see FIG. 4). The one-way roller 300 may further include insertion shafts 311 protruding from both ends at side surfaces of the roller shaft 310.

The diameter of the insertion shafts 311 may be formed smaller than the diameter of the roller shaft 310. Similar to the roller shaft 310, the insertion shafts 311 may extend in the lengthwise direction 110 of the housing (see FIG. 4). In example embodiments, the diameter of the insertion shafts 311 may be provided to be greater than or equal to the diameter of the roller shaft 310.

The insertion shafts 311 may be inserted into the one-way clutch bearing 400 which will be described below. In detail, the insertion shafts 311 may be fixed to inner races 410 of the one-way clutch bearings 400. A detailed structural relationship between the insertion shaft 311 and the one-way clutch bearing 400 will be described below.

The roller body 320 may be formed in a cylindrical shape extending in the lengthwise direction 110 of the housing. The roller body 320 may include a hollow formed in the center thereof in the lengthwise direction 110 of the housing. An extension length of the roller body 320 may be provided in a length corresponding to the roller shaft 310. The extension length of the roller body 320 may be provided the same as the extension length of the roller shaft 310.

The roller shaft 310 may be disposed in the hollow of the roller body 320. The roller body 320 and the roller shaft 310 may be fixed in close contact with each other.

The foreign substance contactor 330 may be disposed on the outer circumferential surface of the roller body 320. In detail, the foreign substance contactor 330 may be provided as a villus. The villus may be formed in a form in which fine hairs extend in a radial direction from the outer circumferential surface of the roller body 320. That is, each of the fine hairs may be provided in the form of being densely embedded in the outer circumferential surface of the roller body 320.

The villus may be made of a nylon-based material. Alternatively, the villus may be formed of an anti-static material. Alternatively, the villus may be formed of a carbon-based soft sole.

In example embodiments, the villus may be formed of a rubber tube rather than a shape of the villus formed by gathering the fine hairs.

Unlike the above-described structure, in example embodiments the foreign substance contactor 330 may be disposed on the outer circumferential surface of the roller shaft 310. That is, in the one-way roller 300, the roller body 320 may be omitted.

Referring to FIGS. 3, 4, and 6, the wheel modules 500 may be arranged at both ends of the one-way roller 300. The wheel modules 500 may be provided to support the roller shaft 310 that is a rotary shaft of the one-way roller 300. The wheel modules 500 may be provided to support the insertion shafts 311 protruding from both ends of the roller shaft 310. One side of the wheel modules 500 may be inserted into the insertion shaft 311. The insertion shaft 311 may be inserted into the one-way clutch bearing 400 provided on one side of the wheel modules 500. The insertion shaft 311 may be fixedly inserted into a rotation center portion of the one-way clutch bearing 400 fixed to the one side of the wheel modules 500. The detailed structural relationship between the insertion shaft 311 and the one-way clutch bearing 400 will be described below.

Referring to FIG. 6, the wheel modules 500 may be arranged at both ends of the one-way roller 300, and a diameter D2 of the wheel modules 500 may be provided greater than the diameter D1 of the one-way roller 300. The wheel modules 500 may be provided to support the roller shaft 310 that is a rotary shaft of the one-way roller 300. Thus, when the suction head 100 is placed on a cleaning surface G (see FIG. 5), the one-way roller 300 may be provided in a structure having a separation distance g (see FIG. 5) from the cleaning surface G.

The structure having the separation distance g from the cleaning surface G is to prevent the one-way roller 300 from being in complete contact with the cleaning surface G and thus being affected due to the complete contact.

Referring to FIGS. 7 and 8, the wheel module 500 may include a wheel frame 510 and an outer cover member 520.

The wheel frame 510 may be formed in a substantially cylindrical shape. The outer cover member 520 may be disposed on an outer circumferential surface of the wheel frame 510. The outer cover member 520 may be provided in a shape corresponding to the outer circumferential surface of the wheel frame 510.

The outer cover member 520 may perform the same function as a tire of a vehicle. The outer cover member 520 may be formed of a material capable of improving a frictional force when in contact with the cleaning surface G. For example, the outer cover member 520 may be formed of a rubber material to improve the frictional force when in contact with the cleaning surface G.

In example embodiments, after the wheel frame 510 is primarily injected, the outer cover member 520 may be secondarily injected, and thus the wheel module 500 may be formed. That is, for continuous injection, the outer cover member 520 may be injected but may be formed using, as an injection-molded material, a material having a higher frictional coefficient than that of the primarily injected wheel frame 510.

A step 513 may be formed on an outer circumferential surface of the wheel frame 510. By using the step 513 on the outer circumferential surface of the wheel frame, the wheel frame 510 may be more tightly coupled to the outer cover member 520. A step 521 may be formed even on an inner circumferential surface of the outer cover member 520. The step 521 on the inner circumferential surface of the outer cover member may be formed to correspond to the step 513 on the outer circumferential surface of the wheel frame 510.

The wheel module 500 may further include a wheel shaft 530 and a wheel bearing 540 for supporting the wheel shaft 530. The wheel module 500 may further include a cap bearing 550 for covering the wheel bearing 540.

The one-way clutch bearing 400 may be disposed on one side surface of the wheel frame 510. The wheel shaft 530 may protrude from the other side surface of the wheel frame 510 and may be provided as a rotary shaft of the wheel frame 510.

As illustrated in FIG. 7, a method in which the wheel shaft 530 protrudes may be provided in a structure in which a wheel shaft insertion groove 514 into which the wheel shaft 530 may be inserted is formed in the other side surface of the wheel frame 510, and the wheel shaft 530 is inserted into the wheel shaft insertion groove 514. The wheel shaft 530 is inserted into the wheel shaft insertion groove 514 so that the wheel shaft 530 may be fixed to the wheel frame 510.

In example embodiments, the wheel shaft 530 may be integrally formed with the wheel frame 510. That is, when the wheel frame 510 is injected, the wheel shaft 530 may also be injection-molded.

Alternatively, in example embodiments, the wheel shaft 530 may be formed to protrude from the lower housing 113. The wheel shaft insertion groove 514 may be rotatably fitted onto the protruding wheel shaft 530.

Referring to FIGS. 7 and 8, the wheel shaft 530 may be rotatably supported by the lower housing 113 immediately after being fixed to the other side surface of the wheel frame 510. However, for durability and smooth rotational movement of the wheel module 500, the wheel bearing 540 may be provided. The wheel shaft 530 may be inserted into and supported by the wheel bearing 540. The wheel bearing 540 may be disposed on an outer circumferential surface of the wheel shaft 530, and the wheel bearing 540 may be supported by the lower housing 113.

Figure 13:
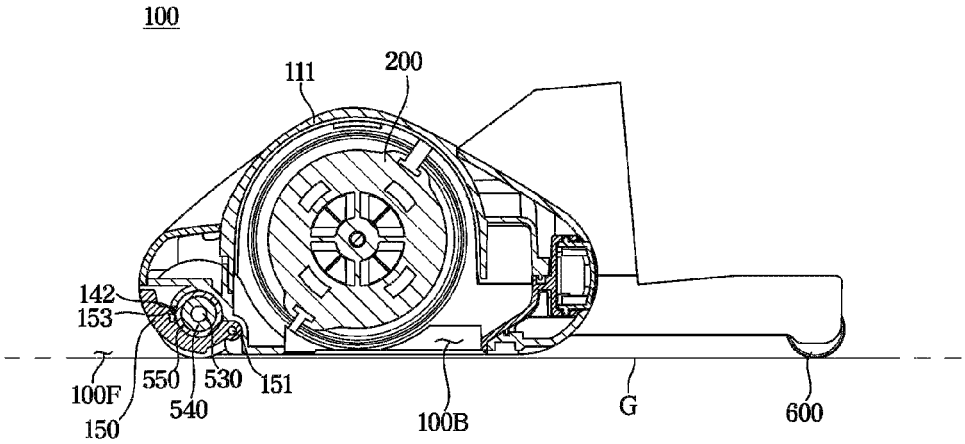
FIG. 13 is a cross-sectional view along line C-C of FIG. 4 when viewed from the left side.

Referring to FIGS. 7, 8, and 13, for the durability and smooth rotational movement of the wheel module 500, the cap bearing 550 may be provided. The wheel bearing 540 may be inserted into and supported by the cap bearing 550. The cap bearing 550 may be disposed on an outer circumferential surface of the wheel bearing 540, and the wheel bearing 540 may be supported by the lower housing 113. In example embodiments, the wheel bearing 540 may also be rotatably supported by the lower housing 113 immediately after the wheel shaft 530 is inserted.

A wheel bearing insertion groove 553 may be formed in one surface of the cap bearing 550. The wheel bearing 540 may be inserted into the wheel bearing insertion groove 553. The wheel bearing 540 may be inserted into the wheel bearing insertion groove 553 of the cap bearing, and the cap bearing 550 may be provided to surround the wheel bearing 540. Since the cap bearing 550 is provided to surround the wheel bearing 540, durability of the wheel bearing 540 can be secured. Since the cap bearing 550 is provided to surround the wheel bearing 540, a defect in the rotational movement of the wheel module 500 due to the foreign substances D accumulated around the wheel shaft 530 of the wheel module 500 can be prevented.

In detail, the cap bearing 550 may include a cap bearing body 551 provided to contact a wheel bearing seat 140 of the lower housing 113, which will be described below, and a visor 552. The visor 552 may be formed in a shape corresponding to the other side surface of the wheel frame 510. The visor 552 may be provided to cover the entirety of the other, or outer, side surface of the wheel frame 510 and prevent the foreign substances D from being accumulated around the wheel shaft 530.

A cap bearing body 551 seated on the wheel bearing seat 140 of the lower housing 113 may be provided in a substantially cylindrical shape. That is, the cap bearing 550 in which the cap bearing body 551 and the visor 552 are integrally formed may be formed in a substantial fedora shape.

The suction head 100 may include the one-way clutch bearing 400 in order to implement the function in which the one-way roller 300 rotates so that the foreign substances D move into the housings 111, 112L, 112R, and 113 when the suction head 100 moves forward and the rotation of the one-way roller 300 is restricted so that the foreign substances D are prevented from being discharged to the outside of the housings 111, 112L, 112R, and 113 when the suction head 100 moves rearward.

An overrunning clutch may be applied to the one-way clutch bearing 400. The overrunning clutch refers to a clutch that transmits a driving force only in one direction. For example, when an outer ring of the clutch rotates in one direction, a rotational force is transmitted to an inner ring of the clutch so that both of the outer ring of the clutch and the inner ring of the clutch may rotate. On the other hand, when the outer ring of the clutch rotates in the other direction opposite to the one direction, the rotational force is not transmitted to the inner ring of the clutch. Thus, the outer ring of the clutch and the inner ring of the clutch may maintain different movement states.

The one-way clutch bearing 400 may be disposed on one side, or inner, surface of the wheel frame 510. In detail, the one-way clutch bearing 400 may be inserted into a wheel frame groove 511 formed in the one side surface of the wheel frame 510. The wheel frame groove 511 may be formed in a shape corresponding to an outer circumferential surface of the one-way clutch bearing 400. The one-way clutch bearing 400 may be fixed after being inserted into the wheel frame groove 511.

In order for the one-way clutch bearing 400 to be fixed to the wheel frame groove 511, a seating groove 421 may be formed in the outer circumferential surface of the one-way clutch bearing 400. The seating groove 421 may be formed in an outer circumferential surface of an outer race 420 of the one-way clutch bearing 400. A one-way clutch bearing fixer 512 may be formed on an inner circumferential surface of the wheel frame groove 511 formed in the one side surface of the wheel frame 510 to correspond to the seating groove 421.

The seating groove 421 and the one-way clutch bearing fixer 512 may be formed in a direction in which a rotation axis of the wheel module 500 is placed. The one-way clutch bearing 400 may be inserted into the wheel frame groove 511, and the seating groove 421 and the one-way clutch bearing fixer 512 may mesh with each other.

The roller shaft 310 of the one-way roller 300 may be inserted into the one-way clutch bearing 400. In detail, the roller shaft 310 may be fixedly inserted into a roller shaft fixer 411 that is an inner circumferential surface of the inner race 410 of the one-way clutch bearing 400.

Referring to FIG. 10, the one-way clutch bearing 400 may include the outer race 420, the inner race 410, and a bearing roller 440.

The outer race 420 may be formed roughly in a cylindrical shape including a hollow in the center thereof. The inner race 410 may be inserted into the hollow of the outer race 420 and rotatably provided inside the outer race 420.

A bearing roller seat 430 into which the bearing roller 440 may be inserted may be formed between an outer circumferential surface of the inner race 410 and an inner circumferential surface of the outer race 420. The inner race 410 includes a bearing roller supporter 412 protruding from the outer circumferential surface of the inner race 410 to support the bearing roller 440 by forming the bearing roller seat 430. For example, as illustrated in FIG. 10, the inner race 410 may be formed in a substantially sawtooth shape.

The bearing roller seat 430 may be formed in a tapered structure that gradually becomes narrower in a movement direction R3 of the bearing roller 440 when the suction head 100, which will be described below, moves forward.

Referring to FIG. 10, the seating groove 421 may be formed in the outer circumferential surface of the outer race 420 of the one-way clutch bearing 400. It is illustrated that two seating grooves 421 are formed. However, for firm coupling between the one-way clutch bearing 400 and the wheel module 500, the number of the seating grooves 421 is not limited to two.

The wheel frame 510 of the wheel module 500 and the one-way clutch bearing 400 may be fixed to each other. Thus, when the suction head 100 moves forward, the wheel module 500 in contact with the cleaning surface G may rotate in a direction R1, and the outer race 420 may also rotate in the direction R1. That is, when the suction head 100 moves forward, a rotation direction of the wheel module 500 and a rotation direction of the outer race 420 may be defined as the "direction R1" (see FIG. 14).

When the outer race 420 rotates in the direction R1, the bearing roller 440 may move in a direction R3. That is, when the suction head 100 moves forward, a movement direction of the bearing roller 440 may be defined as a "direction R3."

The bearing roller seat 430 may be formed in a tapered structure that gradually becomes narrower in the movement direction R3 of the bearing roller 440 when the suction head 100, which will be described below, moves forward. Thus, the bearing roller 440 may move in the direction R3 and come into contact with the inner circumferential surface of the outer race 420 and the outer circumferential surface of the inner race 410. As a result, a rotational force of the outer race 420 may be transferred to the inner race 410. When the suction head 100 moves forward, the inner race 410 rotates in the direction R2.

The roller shaft 310 may be fixedly inserted into the roller shaft fixer 411 that is the inner circumferential surface of the inner race 410 of the one-way clutch bearing 400, which will be described below. Thus, when the inner race 410 rotates in the direction R2, the roller shaft 310 may also rotate in the direction R2. Thus, when the inner race 410 rotates in the direction R2, the one-way roller 300 may also rotate in the direction R2. That is, when the suction head 100 moves forward, a rotation direction of the inner race 410 and a rotation direction of the one-way roller 300 may be defined as the "direction R2."

This state may be defined as a state in which the one-way clutch bearing 400 locks the roller shaft 310 that is the rotation axis of the one-way roller 300 when the suction head 100 moves forward.

Since the one-way clutch bearing 400 is fixed to the wheel modules 500, a state in which the one-way clutch bearing 400 locks the roller shaft 310 may be a state in which the rotational force of the wheel modules 500 is transmitted to the one-way roller 300 and thus the one-way roller 300 also rotates.

In contrast, when the suction head 100 moves rearward, the outer race 420 rotates in a direction opposite to the direction R1. The bearing roller 440 may move in a direction opposite to the direction R3 and come into contact with one of the inner circumferential surface of the outer race 420 and the outer circumferential surface of the inner race 410. In some cases, when moving in the direction opposite to the direction R3, the bearing roller 440 may form a state in which the bearing roller 440 comes into contact with neither the inner circumferential surface of the outer race 420 nor the outer circumferential surface of the inner race 410.

As a result, the rotational force of the outer race 420 may not be transferred to the inner race 410. The outer race 420 and the inner race 410 may maintain different movement states. In other words, the wheel module 500 and the one-way roller 300 may maintain different movement states. For example, the one-way roller 300 is fixed, and only the wheel module 500 may rotate.

This state may be defined as a state in which the one-way clutch bearing 400 unlocks the roller shaft 310 that is the rotation axis of the one-way roller 300 when the suction head 100 moves rearward.

The state in which the one-way clutch bearing 400 unlocks the roller shaft 310 may be a state in which the rotational force of the wheel module 500 is not transmitted to the one-way roller 300, and thus even when the wheel module 500 rotates, the one-way roller 300 may have a different motion state from the wheel modules 500.

Referring to FIGS. 3 to 6, the one-way roller 300, the one-way clutch bearing 400, and the wheel module 500 may share one rotation axis and may be connected to each other in a straight line. That is, the roller shaft 310 of the one-way roller 300 may be connected to the one-way clutch bearing 400 through the insertion shaft 311. In detail, the insertion shaft 311 may be fixed to the roller shaft fixer 411 that is the inner circumferential surface of the inner race 410 of the one-way clutch bearing 400. The one-way clutch bearing 400 may be fixed to the wheel frame groove 511 formed at one side of the wheel frame 510 of the wheel module 500.

Referring to FIGS. 3 to 6, it is illustrated that the same wheel modules 500 are arranged at both ends of the one-way roller 300. However, in example embodiments, the wheel module 500 may be disposed only at one of both ends of the one-way roller 300, and thus the above-described locking or unlocking power transmission structure can be implemented.

The one-way roller 300, the one-way clutch bearing 400, and the wheel module 500 connected to each other in a straight line may be seated on the lower housing 113.

Figure 12:
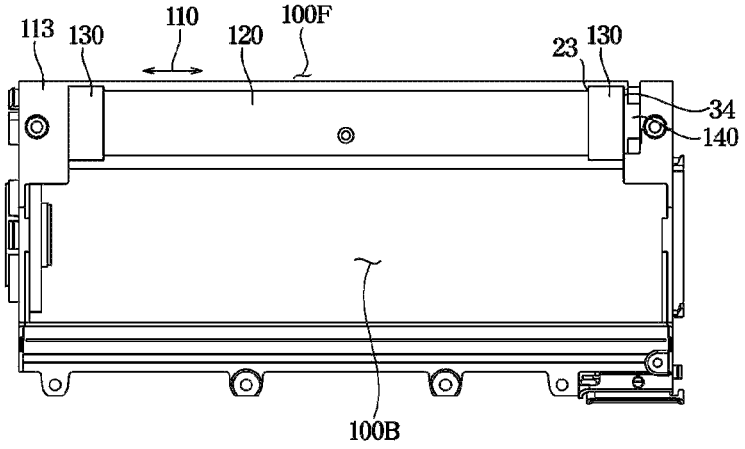
FIG. 12 is a bottom view illustrating the lower housing of the suction head of the vacuum cleaner according to the embodiment of the disclosure.

FIG. 11 is a perspective view illustrating a bottom surface of a lower housing of the suction head of the vacuum cleaner according to an embodiment of the disclosure. FIG. 12 is a bottom view illustrating the lower housing of the suction head of the vacuum cleaner according to the embodiment of the disclosure. FIG. 13 is a cross-sectional view along line C-C of FIG. 4 when viewed from the left side.

Referring to FIGS. 3, 5, 11, and 12, the lower housing 113 may include the roller seat 120 in which the one-way roller 300 is disposed. The roller seat 120 may be formed in front of a position at which the drum brush 200 is disposed. An inner circumferential surface of the roller seat 120 may be formed in a shape corresponding to an upper outer circumferential surface of the one-way roller 300 to be in close contact with the one-way roller 300. In detail, the inner circumferential surface of the roller seat 120 may be formed in a shape corresponding to an outer circumferential surface of the foreign substance contactor 330. The inner circumferential surface of the roller seat 120 may be formed in a substantially cylindrical shape.

Thus, referring to FIG. 5, the region 121 in which the roller seat 120 and the one-way roller 300 rub mutually while in close contact with each other may be formed. The region 121 in which the roller seat 120 and the one-way roller 300 rub mutually while in close contact with each other may be formed to correspond to half of the outer circumferential surface of the one-way roller 300.

Referring to FIGS. 11 and 12, the lower housing 113 may include a wheel seat 130 which is formed on one side of the roller seat 120 and accommodates the wheel module 500. The wheel seat 130 may be formed in a shape corresponding to the wheel module 500, particularly, an outer circumferential surface of the outer cover member 520.

Since the diameter D2 of the wheel module 500 is formed greater than the diameter D1 of the one-way roller 300, a step may be formed at a portion extending from the roller seat 120 to the wheel seat 130. This may be defined as a step 23 between the roller seat 120 and the wheel seat 130.

Unlike the roller seat 120, in example embodiments the wheel seat 130 may not be in close contact with the wheel module 500 and may be spaced apart from the wheel module 500. Through this structure, the wheel module 500 may smoothly rotate.

Referring to FIGS. 11 and 13, the lower housing 113 may further include the wheel bearing seat 140 which is formed on one side of the wheel seat 130 and in which the wheel bearing 540 is seated. In detail, since the cap bearing 550 surrounding the wheel bearing 540 may be disposed on the outer circumferential surface of the wheel bearing 540, an inner circumferential surface of the wheel bearing seat 140 may be in contact with the cap bearing body 551 of the cap bearing 550.

Since the diameter of the wheel bearing 540 is formed smaller than the diameter of the wheel module 500, a step may be formed at a portion extending from the wheel seat 130 to the wheel bearing seat 140. This may be defined as a step 34 between the wheel seat 130 and the wheel bearing seat 140.

Referring to FIGS. 11 to 13, the wheel bearing seat 140 may include an opening 141 that is open to face the bottom surface of the lower housing 113. A plurality of wheel bearing seats 140 may be formed to correspond to the number of the wheel modules 500, and the opening 141 may be formed in only some of the plurality of wheel bearing seats 140. FIGS. 11 and 12 illustrate that an opening is formed in the wheel bearing seat 140 formed adjacent to the left side cover 112L, but the disclosure is not limited thereto.

The suction head 100 may further include a support hook 150 so that the one-way roller 300 and the wheel module 500 connected to each other in a straight line may be fixedly arranged in the roller seat 120, the wheel seat 130, and the wheel bearing seat 140. The support hook 150 may be formed in a substantially hook shape.

Referring to FIGS. 11 and 13, the support hook 150 may be provided to close the opening 141 and support the wheel bearing 540 seated in the wheel bearing seat 140. In detail, since the cap bearing 550 surrounding the wheel bearing 540 may be disposed on the outer circumferential surface of the wheel bearing 540, an inner circumferential surface 152 of the support hook 150 and the cap bearing body 551 of the cap bearing 550 may be in contact with each other.

One end of the support hook 150 may be rotatably coupled to the lower housing 113. The support hook 150 may rotate about a support hook rotary shaft 151.

A fastening protrusion 153 may be formed at the other end of the support hook 150 so that the support hook 150 may be fixedly hooked to the lower housing 113. A fastening groove 142 may be provided in the lower housing 113 at a position corresponding to the fastening protrusion 153.

In the suction head 100, when the one-way roller 300 and the wheel module 500 connected to each other in a straight line are seated inside the roller seat 120, the wheel seat 130, and the wheel bearing seat 140, the support hook 150 rotates toward the lower housing 113, and the fastening protrusion 153 and the fastening groove 142 may be then coupled to each other.

Figure 14:
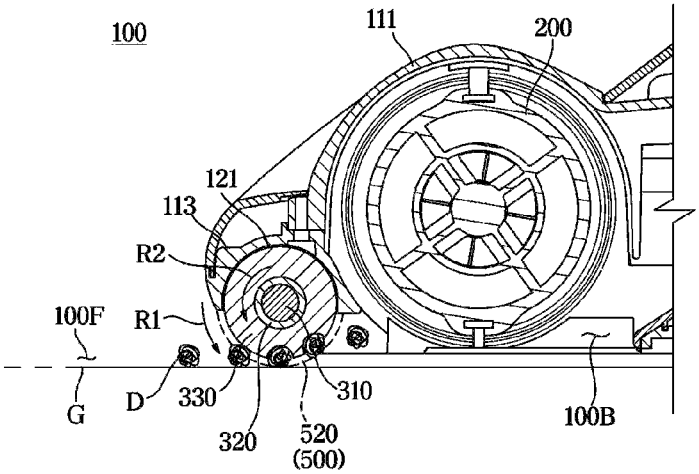
FIG. 14 is a part of the cross-sectional view of FIG. 5 for describing an operation process when the suction head of the vacuum cleaner according to the embodiment of the disclosure moves forward.
Figure 15:
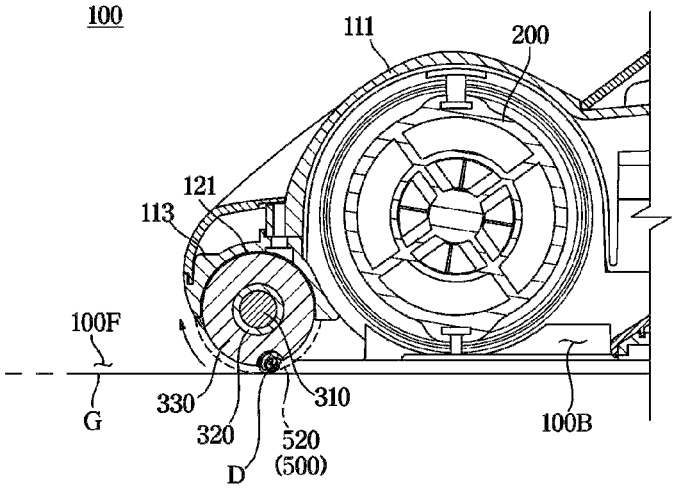
FIG. 15 is a part of the cross-sectional view of FIG. 5 for describing an operation process when the suction head of the vacuum cleaner according to the embodiment of the disclosure moves rearward.

FIG. 14 is a part of the cross-sectional view of FIG. 5 for describing an operation process when the suction head of the vacuum cleaner according to the embodiment of the disclosure moves forward. FIG. 15 is a part of the cross-sectional view of FIG. 5 for describing an operation process when the suction head of the vacuum cleaner according to the embodiment of the disclosure moves rearward.

Referring to FIG. 14, when the suction head 100 moves forward, since the outer cover member 520 of the wheel module 500 is in contact with the cleaning surface G, the outer cover member 520 rotates in the direction R1. When the suction head 100 moves forward, since the one-way clutch bearing 400 and the roller shaft 310 of the one-way roller 300 are locked, the one-way roller 300 and the wheel module 500 rotate in the same direction. That is, even when a frictional force is applied to the region 121 in which the roller seat 120 and the one-way roller 300 rub mutually while in close contact with each other, a larger rotational force transmitted from the wheel module 500 is applied, and thus the one-way roller 300 and the wheel module 500 may rotate in the same direction.

The one-way roller 300 comes into contact with the foreign substances D on the cleaning surface G while rotating, and the foreign substances D are introduced into the housings 111, 112L, 112R, and 113 in the direction R2 that is the rotational direction of the one-way roller 300.

In contrast, referring to FIG. 15, when the suction head 100 moves rearward, since the outer cover member 520 of the wheel module 500 is in contact with the cleaning surface G, the outer cover member 520 rotates in a direction opposite to the direction R1. When the suction head 100 moves rearward, since the one-way clutch bearing 400 and the roller shaft 310 of the one-way roller 300 are unlocked, the rotational force of the wheel module 500 is not transmitted to the one-way roller 300.

Rather, the one-way roller 300 tries to maintain a rotational state in the direction R2 illustrated in FIG. 14 due to a rotation inertia force in a forward state, and after a certain time has elapsed, the rotation of the one-way roller 300 is restricted due to a frictional force of the region 121 in which the roller seat 120 and the one-way roller 300 rub mutually while in close contact with each other. That is, a state of being fixed to the lower housing 113 is maintained due to the frictional force of the region 121 in which the roller seat 120 and the one-way roller 300 rub mutually while in close contact with each other. In particular, since the one-way roller 300 is spaced apart from the cleaning surface G, a frictional force with the cleaning surface G is not applied. Thus, as the rotation of the one-way roller 300 in the direction opposite to the direction R2 is restricted, the foreign substances D introduced into the housing are caught by the one-way roller 300 when the suction head 100 moves rearward, and accordingly, the foreign substances D can be prevented from being separated and returned to the outside of the suction head 100.

Although a few embodiments of the disclosure have been shown and described, it would be appreciated by those skilled in the art that changes may be made in these embodiments without departing from the principles and spirit of the disclosure, the scope of which is defined in the claims and their equivalents.

What is claimed is:

1. A vacuum cleaner comprising:

a cleaner body including a motor configured to generate a suction force and a foreign substance collection chamber; and a suction head connected to the cleaner body and including:

a housing having a suction port, a drum brush, a one-way roller disposed in front of the drum brush, a wheel module supporting the suction head and disposed on at least one end of the one-way roller, and a one-way clutch bearing coupled to, and coaxial with, the wheel module and the at least one end of the one-way roller, wherein the drum brush and the one-way roller are configured so that, when the suction head is moving forward on a surface to be cleaned with the wheel module rotating forward, the drum brush and the one-way roller rotate so that foreign substances on the surface are suctioned by the suction force into the housing through the suction port to be guided to the foreign substance collection chamber, and when the suction head is moving rearward on the surface with the wheel module rotating rearward, rotation of the one-way roller is restricted to prevent the foreign substances suctioned into the housing from being discharged outside of the housing of the suction head through the suction port.

2. The vacuum cleaner of claim 1, wherein the one-way roller includes:

a roller shaft, and a roller body that is fixed to an outer circumferential surface of the roller shaft and configured so that, when the suction head is on the surface, the one-way roller contacts at least some of the foreign substances on the surface under the suction head.

3. The vacuum cleaner of claim 2, wherein the one-way clutch bearing is configured to support the at least one end of the roller shaft.

4. The vacuum cleaner of claim 3, wherein the one-way clutch bearing locks the roller shaft so that the roller shaft rotates during the forward movement of the suction head, and unlocks the roller shaft so that the roller shaft is restricted from rotation during the rearward movement of the suction head.

5. The vacuum cleaner of claim 2, wherein the one-way roller further includes a foreign substance contactor disposed on an outer circumferential surface of the roller body and including a villus configured to, when the suction head is on the surface, contact the at least one of the foreign substances on the surface under the suction head.

6. The vacuum cleaner of claim 3, wherein the wheel module is configured to support at the at least one end of the roller shaft through the one-way clutch bearing.

7. The vacuum cleaner of claim 6, wherein the wheel module includes:

a wheel frame to which the one-way clutch bearing is fixed on an inner side surface of the wheel frame;

a wheel shaft protruding from an outer side surface of the wheel frame and configured as a rotary shaft of the wheel frame; and a wheel bearing supporting the wheel shaft.

8. The vacuum cleaner of claim 7, wherein, the housing includes a roller seat in which the one-way roller is disposed, and an inner circumferential surface of the roller seat is provided in a shape so that an upper outer circumferential surface of the one-way roller contacts the inner circumferential surface of the roller seat to provide friction between the inner circumferential surface of the roller seat and the upper outer circumferential surface of the one-way roller.

9. The vacuum cleaner of claim 8, wherein the housing further includes:

a wheel seat which is formed on one side of the roller seat in a longitudinal direction of the housing, and which accommodates the wheel module; and a wheel bearing seat which is formed on an outer side of the wheel seat in the longitudinal direction of the housing and in which the wheel bearing is seated.

10. The vacuum cleaner of claim 9, wherein, the wheel bearing seat includes an opening facing a bottom surface of the housing, and the vacuum cleaner further includes a support hook configured to close the opening and support the wheel bearing seated in the wheel bearing seat, the support hook having one end rotatably coupled to the housing, and having another end removably connected to the housing so as to support the wheel bearing.

11. The vacuum cleaner of claim 7, wherein the wheel frame includes a wheel frame opening formed in the inner surface of the wheel frame so that the one-way clutch bearing is fixedly inserted into the wheel frame opening.

12. The vacuum cleaner of claim 6, wherein a diameter of the wheel module is greater than a diameter of the one-way roller.

13. The vacuum cleaner of claim 7, further comprising:

a plurality of the wheel modules, wherein at least one wheel module of the plurality of wheel modules further includes an outer cover member fixed to and surrounding an outer circumferential surface of the wheel frame of the wheel module.

14. The vacuum cleaner of claim 13, wherein the outer cover member is configured so as to, when the suction head is on the surface, contact the surface, and is formed of a rubber material to increase a frictional force with the surface.

* * * * *